US005160905A

United States Patent [19]

Hoang

[11] Patent Number: 5,160,905

[45] Date of Patent: Nov. 3, 1992

[54] HIGH DIELECTRIC MICRO-TROUGH LINE FILTER

[75] Inventor: Truc G. Hoang, San Diego, Calif.

[73] Assignee: Motorola, Inc., Schaumburg, Ill.

[21] Appl. No.: 734,382

[22] Filed: Jul. 22, 1991

[51] Int. Cl.[5] ..... H01P 1/203

[52] U.S. Cl. ..... 333/204; 333/203

[58] Field of Search ..... 333/202-205, 333/219, 238, 246

[56] References Cited

U.S. PATENT DOCUMENTS 4,785,271 11/1988 Higgins, Jr. ..... 333/222 X

FOREIGN PATENT DOCUMENTS 0413211 2/1991 European Pat. Off. ..... 333/219

0050702 4/1980 Japan ..... 333/238

0248005 12/1985 Japan ..... 333/246

0161803 7/1986 Japan ..... 333/204

0201501 9/1986 Japan ..... 333/204

0085403 3/1989 Japan ..... 333/202

*Primary Examiner*—Paul M. Dzierzynski

*Assistant Examiner*—Seung Ham

*Attorney, Agent, or Firm*—Joseph P. Krause

[57] ABSTRACT

Improved Q factor for stripline and microstrip filters can be realized by increasing the thickness of conductive paths. Increased conductive paths in a stripline and microstrip filter can be realized by forming slots (20) in a block of dielectric material (12) which permit an increased thickness of transmission path thereby improving the Q factor of the material by reducing at least resistive losses.

18 Claims, 4 Drawing Sheets

HIGH DIELECTRIC MICRO-TROUGH LINE FILTER

FIELD OF THE INVENTION

This invention relates to electrical filters. More particularly this invention relates to so-called stripline and microstrip electrical filters.

BACKGROUND OF THE INVENTION

Electrical filters are well known in the electronic art. In general, such filters are typically either bandpass, lowpass, highpass, and band reject or notch filters. Each of these filter types, in any particular application, will be required to have certain operational or functional characteristics such as cutoff frequencies, bandwidths, Q-factor etc., that will each be affected by many factors including, for example, whether or not the components that comprise the filter are active or passive components, the topology or physical arrangement of components on a circuit board, etc.

At high frequencies, i.e., over 200 MHz, so-called transmission line elements are frequently used to perform signal filtering. So-called stripline or microstrip designs, in general, have improved performance characteristics compared to filters using so-called lumped elements (discrete resistors, capacitors, inductors, as well as active circuitry) because these microstrip and stripline filters are constructed of transmission lines the electrical lengths of which determine whether or not a particular filter will be a bandpass, a band stop, a lowpass or a highpass, etc., and which thereby avoid problems such as parasitic, and stray, inductance, capacitance, and resistance.

A microstrip filter is generally considered to be a layer of conductive material, frequently considered a ground plane or reference plane, on one side of a dielectric substrate, where such as a dielectric substrate has the opposite side of the circuit board coated with conductive material, the physical lengths of which closely correspond to electrical lengths of transmission line at radio frequencies of interest. In a sense, a microstrip filter is merely a length of conductive material on a dielectric substrate that typically forms either a quarter wavelength or half wavelength transmission line for a particular signal. This length of conductive material is deposited on to one surface of a dielectric substrate (usually a circuit board), the opposite surface of which has coupled to it a substantially continuous plane of conductive material, which is usually coupled to ground.

A stripline filter, is generally considered to be a layer of conductive material sandwiched between two dielectric layers, which dielectric layers are themselves sandwiched between two conductive layers. In a stripline filter, layers of dielectric material have running through them, the signal conductor or signal trace, where upon both the outer surfaces of the dielectric layers are coated with conductive material. A stripline filter that has the signal layer sandwiched between two dielectric layers that are sandwiched between conductive layers provides an inherent improvement over a microstrip filter in that signals on the conductive layer in a stripline filter are electrically shielded by both the upper and lower conductive layers on the dielectric material. (Although a microstrip filter does not provide the signal shielding that a stripline provides, a microstrip filter is considerably easier to manufacture and hence has a lower inherent cost.)

In both the microstrip and stripline filters, the Q factor or quality factor of the filter is directly proportional to the geometry and construction of the signal layers. In both microstrip and stripline filters, a higher Q factor can be most easily realized by increasing the thickness of the signal layer, in part because of resistive losses, (which are reduced with thicker layers of conductive material) that which are proportional to the amount of material available upon which signal can be conducted.

In fabricating both microstrip and stripline filters, there is an upper limit above which Q factor might not be increased by increasing the thickness of the conductive signal layer. Since conductive signal layers in both microstrip and stripline filters are typically screen printed using well known techniques in the art, the thickness of the layer of material that can be screen printed is limited by the viscosity of the paste and by the desired accuracy and registration of the patterning of the signal layers that may be realized in a screen printing process. As the desired thickness of a film that is to be screen printed increases, (thereby permitting increases in conductive layer thickness) the paste material that is screen printed on to a substrate may begin slump as the viscus material sags both before and during its curing process. The slumping of this viscus paste material that comprises the conductive layer after its curing, decreases the accuracy and registration of a desired pattern which in turn deteriorates the desired Q factor of the filter as well as other operating characteristics of the filter.

A high frequency microstrip or stripline filter that improves the Q factor available over that which is attainable using prior art screen printing techniques would therefore be an improvement over the prior art.

SUMMARY OF THE INVENTION

There are disclosed stripline and microstrip filters that have improved Q factors that are realized in part by having a dielectric substrate formed from a block of dielectric material that includes slots formed within the block which are either plated with conductive material or are substantially filled with conductive material that form the conductive signal paths of a stripline or microstrip filter element. Where the slots are filled with material, the slots in the dielectric material permit the thickness of the conductive material to be increased without the accompanying slump that occurs when the viscus conductive paste is screen printed on to a surface. Where the slots in the substrate are coated or plated with material, the edge definition (shape of the edges) of the conductive material plated or coating the slots exceeds the definition attainable by screen printing producing a Q factor improvement over screen printed patterns.

DESCRIPTION OF A PREFERRED EMBODIMENT

Figures 1A, 1B:
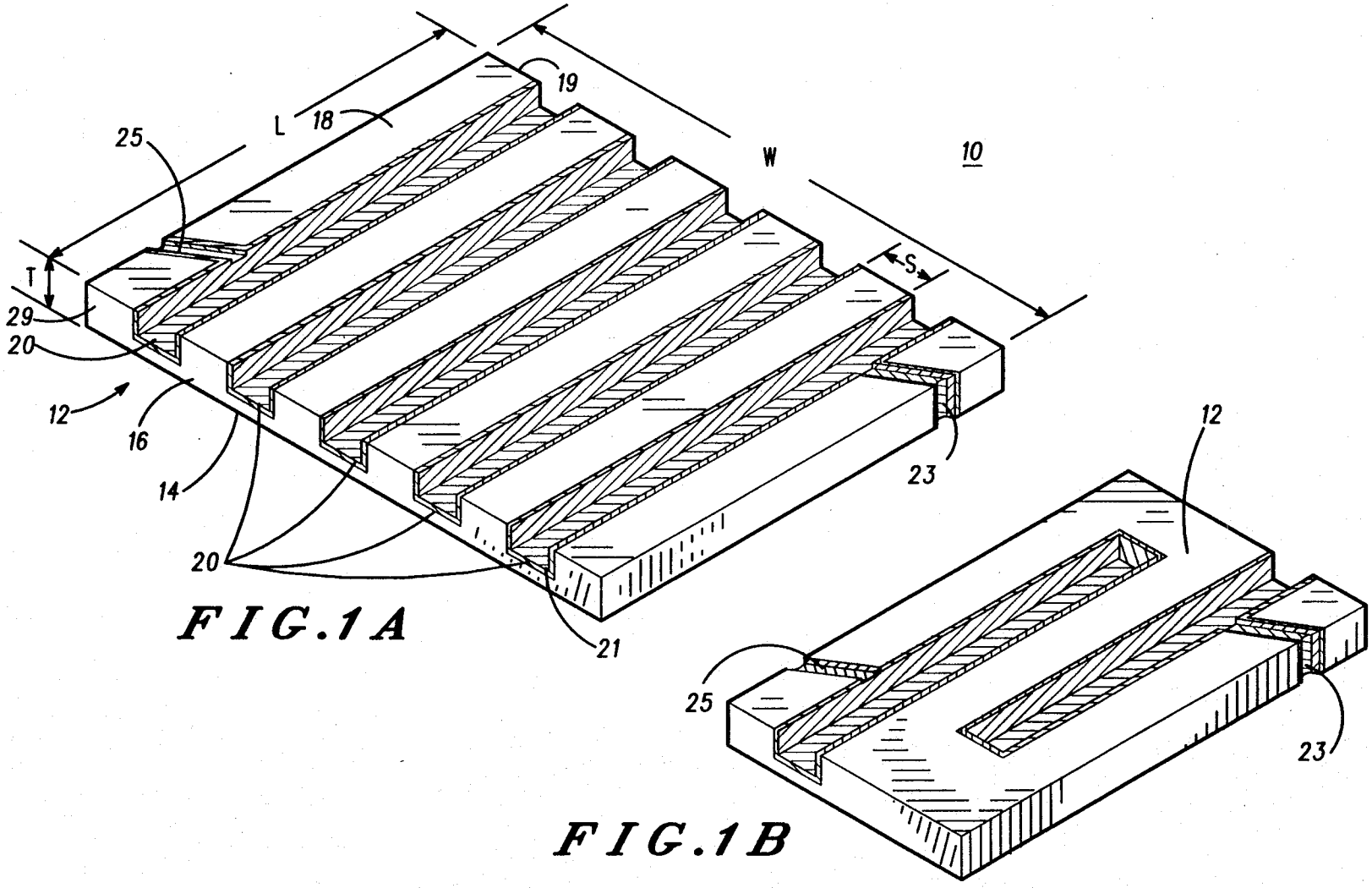
FIG. 1A shows an isometric view of a dielectric substrate with included slots that extend completely across the substrate.
FIG. 1B shows an isometric view of a dielectric substrate with included slots that extend part way across the substrate.

FIG. 1A shows an isometric view of a substrate (10) that is comprised of a rectangular block of dielectric material (12). The block (12) has a plurality of slots (20) cut through it, each of which forms a so-called micro-trough in the block (12). The block, as shown in FIG. 1, has a length L, a width W and a thickness T.

The block (12) has a substantially planar upper surface (18) and a substantially planar lower surface (14). In the embodiment shown in FIG. 1, the block (10) has the slots (20) formed in it through the upper surface (18) such that the slots (20) extend entirely across the entire length of the block (12) as shown. (Alternate embodiments of the invention would include blocks that do not have slots that extend across the entire length L of the block, such as the block shown in FIG. 1B, but such an embodiment might be more difficult to fabricate.)

In the embodiments shown in FIG. 1A and FIG. 1B, the block (12) is a dielectric material that is preferably a ceramic material, such as neodymium titanate or barium titanate, although other suitable dielectric materials might include glass, plastic, ferrite, for example. When using a ceramic, the slots (20) are more readily formed before firing the ceramic and in the preferred embodiment the slots are actually formed in the block (12) when ceramic, while still in powder form, is pressed in a mold to render the shape shown in FIG. 1A and FIG. 1B. In FIG. 1A, the interior surfaces of the block (12) that form the sides and bottoms of the slots (20) are shown as coated with a thin layer (21) of conductive material, which could be applied using any appropriate technique for applying thin films, including spraying or vapor deposition for example. This thin conductive layer (21) behaves similarly to another embodiment of the invention in which the slots (20) are substantially filled with conductive material. Merely coating the surfaces of the slots (20) however reduces the amount of conductive material that must be used and might produce a cost reduction over filling the slots with conductive material.

In FIG. 1A and FIG. 1B, input/output traces (23 and 25) on the sides of the block (12), which in the preferred embodiment are screen printed traces of conductive material, wrap around the corners of the block (12) near both it's upper surface (18) and it's lower surface (14) to electrically couple the conductive material in the slots (20) to input/output pads (27 and 29) on lower surface (14) of the block (12) shown in these figures.

Figure 2:
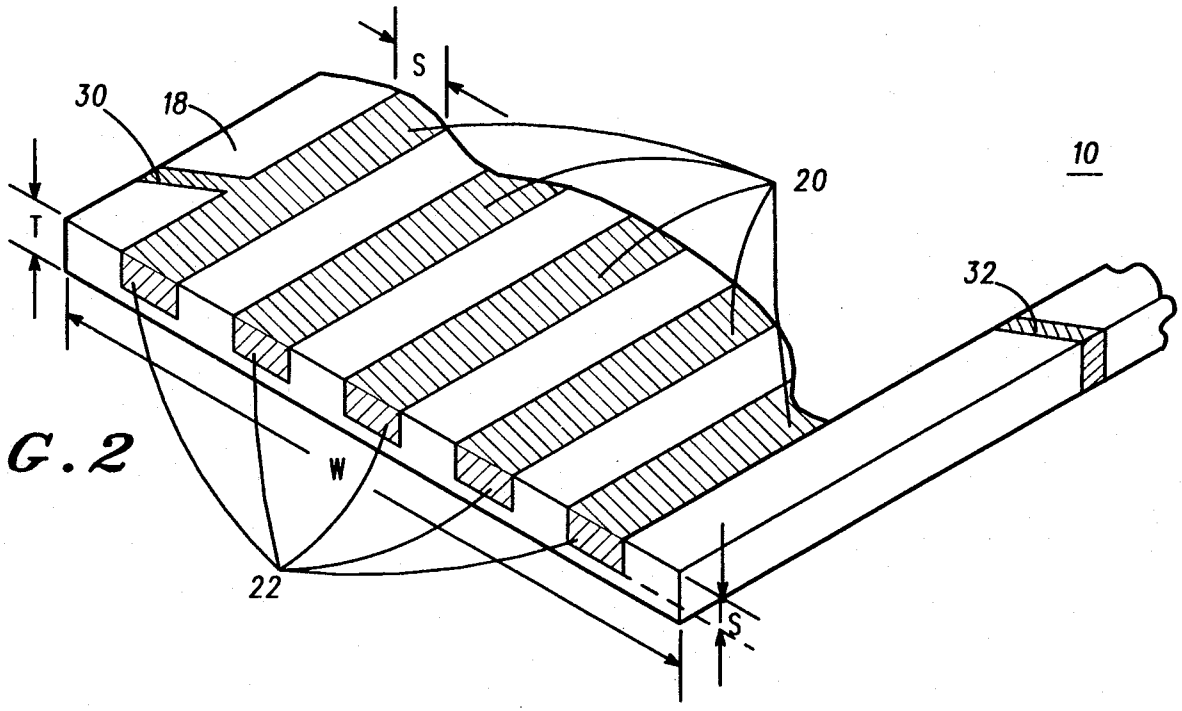
FIG. 2 shows a cross-sectional view of the slots of the dielectric substantially filled with conductive material.

FIG. 2 shows another view of the substrate shown in FIG. 1A albeit in FIG. 2 the slots (20) are substantially filled with a conductive paste, (22) which after curing, forms the conductive signal paths in either a stripline or microstrip filter embodiment. In FIG. 2, the depth of the slots, $T_S$, extends at least partially through the thickness T of the block (12) such that the depth of the slots, $T_S$, can be made substantially greater than the thickness of a conductive signal layer that would be attainable using screen printing processes in the prior art. It is the increased thickness $T_S$ of the depth of the slots, which permits thicker signal paths over those attainable with screen printed techniques, that produces an improvement in the Q factor of a filter formed using the dielectric substrate (10) shown in FIGS. 1 and 2.

In FIG. 2, signals are input to and extracted from the slots (20) (whether the slots are filled with conductive material or coated with conductive material) by means of the input/output (I/O) traces (30 and 32), that are printed onto at least the top surface (18) of the block (12). A comparison of the I/O traces shown in FIG. 2 with the I/O traces shown in FIGS. 1A and 1B will reveal that the traces are similar. (The block shown in FIG. 1A and FIG. 1B shows I/O traces that are printed onto the top surface (18), wrap around onto and extend across a side surface to the bottom surface (14).)

Figure 3:
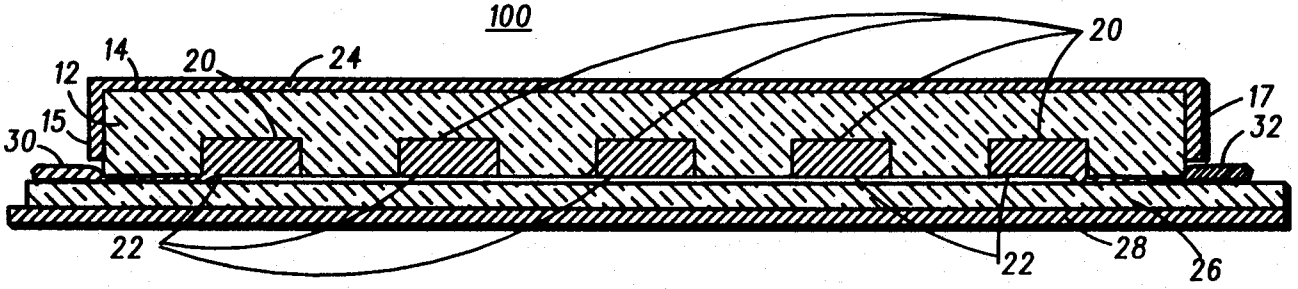
FIG. 3 shows a cross-sectional view of a stripline filter using the substrate shown in FIG. 1 and FIG. 2.

FIG. 3 shows a cross-sectional diagram of a stripline style filter (100). In FIG. 3, the dielectric block (12) is shown inverted from the orientation shown in FIGS. 1A, 1B, and 2. In FIG. 3, the slots (20) are substantially filled with conductive material (22). Input/output traces (30 and 32), which are printed onto the block, (and which are also shown in FIG. 2) permit signals to be coupled into and out of the filter. In addition to inverting the block (12) from that shown in FIGS. 1A and 2, the lower surface of the block (14) (that is the lower surface as shown in FIG. 1A) is covered with a layer of conductive material (24) which extends not only across the surface (14) of the block (12), but also on to the side surfaces (15 and 17) as shown, to provide the shield layers that are characteristic of stripline filters as described above.

The block (12) shown in FIG. 3 is mounted onto the upper surface of a dielectric substrate (26) (which is in most applications is a circuit board constructed of a suitable dielectric material) the lower surface of which has deposited on to it a substantially uniform layer of conductive material (28) that is generally considered a ground plane or signal reference plane.

The lower dielectric substrate (26), which might also be a ceramic substrate, such as those used for a so-called thick hybrid circuit, also has substantially planar upper and lower surfaces. Signals can be coupled to the conductive material (22) deposited in the slots (20) by means of a conductive signal path (39) that is a layer of conductive material on the upper surface of the circuit board (26). Signals can be input to and extracted from the filter (100) by means of input/output traces, such as the traces shown in FIG. 2 (30 and 32) but which are not readily shown in FIG. 3. (Alternate embodiments would of course include input/output leads that are not exclusively on the upper surface of the circuit board but might also find themselves as feed-through holes, or vias, which are holes through the block (12) that can be either coated or filled with conductive material and that intersect the metallization within a slot (20). Via holes, such as the via holes (38 and 40) shown in FIG. 4, could extend through the block (12) from the bottom of a slot (20) to the lower surface (14) of the block (12) providing on the lower surface (14) a contact point suitable for so-called surface mount manufacturing techniques.)

Figure 4:
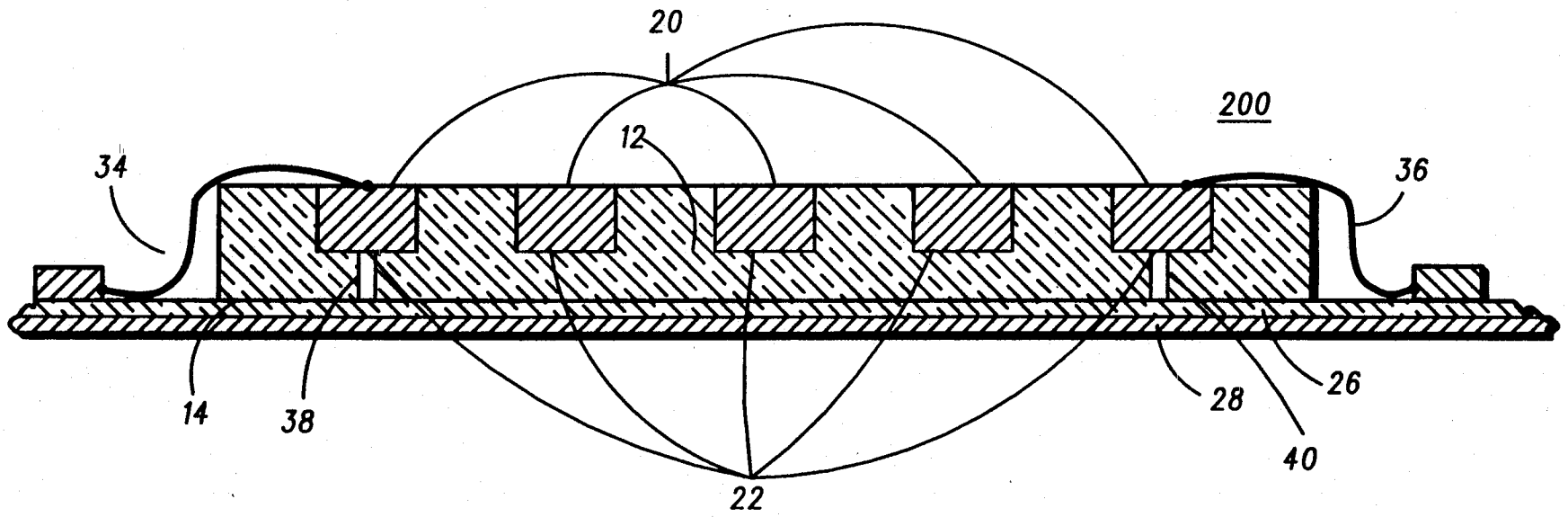
FIG. 4 shows a cross-sectional view of a microstrip filter.

FIG. 4 shows an alternate embodiment of the invention that is a microstrip filter (200) constructed using the substrate (10) shown in FIGS. 1 and 2. In the embodiment shown in FIG. 4 the substrate block (12) has the slots (20) again filled with conductive material (22) with the notable exception that in the embodiment shown in FIG. 4 and unlike the embodiment shown in FIG. 3, the conductive material filled slots (20) are in the same orientation as shown in FIGS. 1 and 2. In the microstrip filter (200) signals are coupled into the conductive layer by conductive leads (34 and 36) that, as shown in FIG. 4, are soldered to conductive traces on the surface of the circuit board (26). Alternate embodiments would include using the conductive feed-through vias (38 and 40) that extend through the block (12) from the bottom of a slot (20) to the bottom surface (14) of the block (12). As shown in other figures, in FIG. 4 there is a lower ground or reference plane (28) that in most applications is a layer of conductive material bonded to the circuit board (26).

Figure 5:
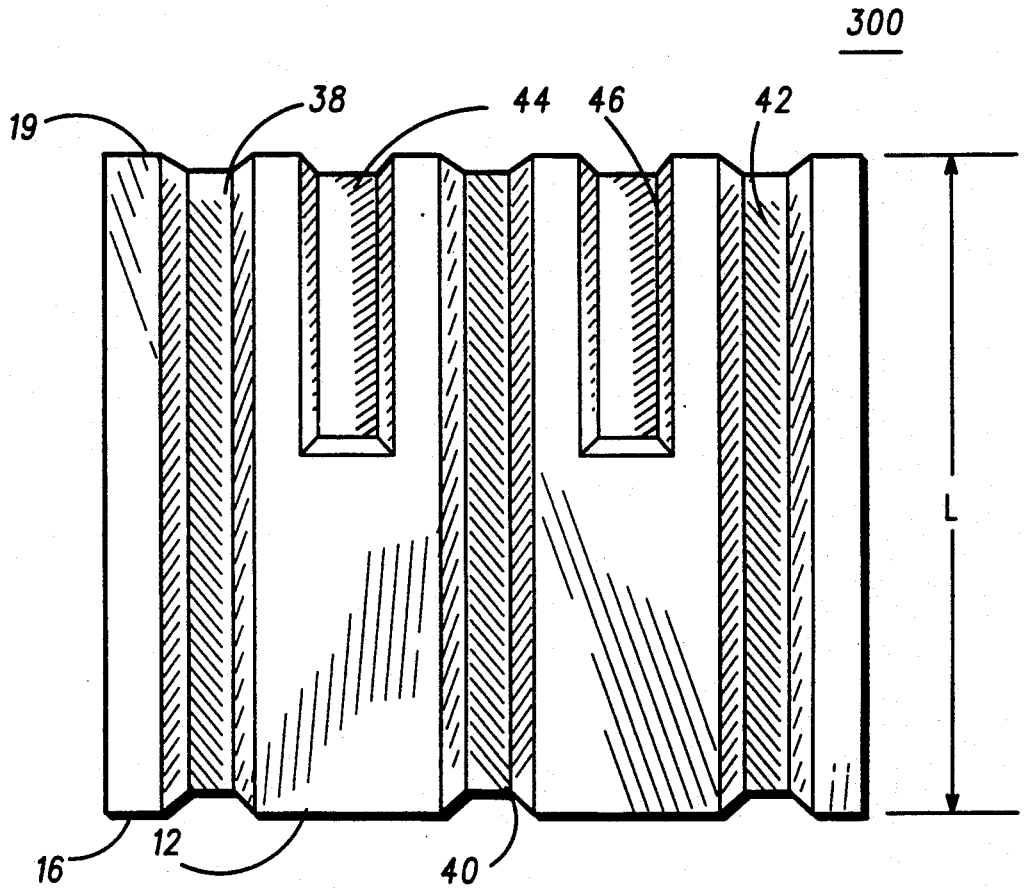
FIG. 5 shows a top view of a substrate used to achieve an inter-digital micro-trough filter.

FIG. 5 shows another embodiment of the invention which is an interdigital filter (300). FIG. 5, which is a top view of the block (12), shows filter stages formed by slots that extend completely through the length L of the block (12). The filter stages, which are quarter-wavelength transmission lines formed by slots 38, 40 and 42, comprise the principal elements of an interdigital filter. Only one end of each of these slot sections (38, 40, 42, 44, 46) is coupled to ground by means of metallization of either the upper surface (19) or the lower surface (16) of the block (12) as shown. Conductive via holes can also be used to couple the sections to ground as well. Of particular significance in an interdigital filter is that adjacent ends of these stages that are alternatley grounded. For example, the end of slot 38 proximate to the upper end (19) of the block might be coupled to a ground layer of material on the surface (19) with the end of the slot 42 proximate to the upper layer (19) also being coupled to a layer of ground material on the upper surface (19). As for the middle slot (40), in an interdigital filter, it would be coupled to a ground potential at the end proximate to the lower surface (16) with its end proximate to the upper surface (19) isolated from the ground layer of material on the upper surface (19). Grounding either end of any slot would also be feasible using conductive via holes.

The other two slots (44 and 46) in the block (12) are isolation slots that are used to control coupling between the resonators in the block (12).

In the embodiment shown in FIGS. 3 and 4, a 5 pole filter is realized by virtue of the five individual slots (20) that are filled with conductive material. Alternate embodiments will of course contemplate using more or fewer slots as the desired characteristics of the filters change.

In the preferred embodiment, the material that fills the slots is a palladium alloy paste, whereas the block is comprised of a material such as barium tita-nate, neodymium titanate, or other high-K ceramic material.

While the stripline and microstrip embodiments disclosed herein are shown on second substrates, which are typically circuit boards, those skilled in the art will recognize that the blocks shown in FIGS. 1A, 1B, 2 could be used as ceramic filters themselves, without having any attachment to another substrate. The embodiments shown in these figures will still be comprised of physical lengths of conductive material, which at some frequency, will have electrical lengths that correspond to either a quarter-wavelength transmission line or a have-wavelength transmission line. At these frequencies, the embodiments shown in these figures, will behave as electrical filters. Using a second substrate such as a circuit board with a ground layer provides an improvement in the electrical performance.

What is claimed is:

1. A stripline filter having an improved Q factor comprised of:

a first dielectric substrate having upper and lower substantially planar surfaces;

a first ground plane comprised of a layer of electrically conductive material deposited onto said lower surface of said first dielectric substrate;

a second dielectric substrate, comprised of a substantially rectangular block of dielectric material, said block having a length, a width, and a substantially uniform thickness, said block having a substantially planar upper surface and having a substantially planar lower surface that includes a plurality of substantially rectangular-cross sectioned, substantially parallel slots, said slots having lengths, widths and depths and being spaced apart from each other along the width of said block, said slots extending at least partially across the length of said block, the depths of said slots extending partially through the thickness of said block of dielectric material, said slots being substantially filled with conductive material, portions of said lower surface of said block of dielectric material between said slots being substantially uncoated, said lower surface of said block of dielectric material being coupled to said upper surface of said first dielectric substrate;

input terminal means for coupling electrical signals to conductive material in said slots from a source of said electrical signals; and output terminal means for coupling electrical signals from conductive material in said slots to a destination for said electrical signals.

2. The stripline filter of claim 1 where said second dielectric substrate is comprised of ceramic.

3. The stripline filter of claim 1 where said slots are uniformly distributed across the width of said block and are uniformly spaced apart from each other.

4. The stripline filter of claim 1 where said slots extend completely across the length of said block.

5. The stripline filter of claim 1 where said input terminal means is a screen-printed conductive pattern on said second dielectric substrate.

6. The stripline filter of claim 1 where said output terminal means is a screen-printed conductive pattern on said second dielectric substrate.

7. A microstrip filter having an improved Q factor comprised of:

a dielectric substrate, comprised of a substantially rectangular block of dielectric material, said block having a length, a width, and a substantially uniform thickness, said block having a substantially planar lower surface and having a substantially planar upper surface that includes a plurality of substantially rectangular-cross sectioned, substantially parallel slots, said slots having lengths, widths and depths and being spaced apart from each other across the width of said block, said slots extending at least partially across the length of said block, the depths of said slots extending partially through the thickness of said block of dielectric material, said slots being completely filled with conductive material portions of said upper surface of said block of dielectric material between said slots being substantially uncoated, said lower surface of said block of dielectric material being coupled to said upper surface of said dielectric substrate input terminal means for coupling electrical signals to conductive material in said slots from a source of said electrical signals; and output terminal means for coupling electrical signals from conductive material in said slots to a destination for said electrical signals.

8. The microstrip filter of claim 7 where said dielectric substrate is comprised of ceramic.

9. The microstrip filter of claim 7 where said slots are uniformly distributed across the width of said block and are uniformly spaced apart from each other.

10. The microstrip filter of claim 7 where said slots extend completely across the length of said block.

11. The microstrip filter of claim 7 where said input terminal means is a screen-printed conductive pattern on said dielectric substrate.

12. The microstrip filter of claim 7 where said output terminal means is a screen-printed conductive pattern on said dielectric substrate.

13. A ceramic filter having an improved Q factor comprised of:

a dielectric substrate, comprised of a substantially rectangular block of dielectric material, said block having a length, a width, and a substantially uniform thickness, said block having a substantially planar upper surface and having a substantially planar upper surface that includes a plurality of substantially rectangular-cross sectioned, substantially parallel slots, said slots having lengths, widths and depths and being spaced apart from each other along the width of said block, said slots extending at least partially across the length of said block, the depths of said slots extending partially through the thickness of said block of dielectric material, said slots being completely filled with conductive material, portions of said upper surface of said block of dielectric material between said slots being substantially uncoated;

input terminal means for coupling electrical signals to conductive material in said slots from a source of said electrical signals; and output terminal means for coupling electrical signals from conductive material in said slots to a destination for said electrical signals.

14. The filter of claim 13 where said input terminal means is a screen-printed conductive pattern on said dielectric substrate.

15. The filter of claim 13 where said output terminal means is a screen-printed conductive pattern on said dielectric substrate.

16. A ceramic filter having an improved Q factor comprised of:

a dielectric substrate, comprised of a substantially rectangular block of dielectric material, said block having a length, a width, and a substantially uniform thickness, said block having a substantially planar upper surface and having a substantially planar upper surface that includes a plurality of substantially rectangular-cross sectioned, substantially parallel slots, said slots having lengths, widths and depths and being spaced apart from each other along the width of said block, said slots extending at least partially across the length of said block, the depths of said slots extending partially through the thickness of said block of dielectric material, said slots being substantially filled with conductive material, portions of said upper surface of said block of dielectric material between said slots being substantially uncoated;

input terminal means for coupling electrical signals to conductive material in said slots from a source of said electrical signals; and output terminal means for coupling electrical signals from conductive material in said slots to a destination for said electrical signals.

17. The filter of claim 16 where said input terminal means is a screen-printed conductive pattern on said dielectric substrate.

18. The filter of claim 16 where said output terminal means is a screen-printed conductive pattern on said dielectric substrate.

* * * * *